US005931726A

United States Patent [19]

Peters

[11] Patent Number: 5,931,726

[45] Date of Patent: Aug. 3, 1999

[54] ADJUSTMENT PLATE

[76] Inventor: Jeffrey T. Peters, 3562 Easton St. NE, North Canton, Ohio 44721

[21] Appl. No.: 08/994,765

[22] Filed: Dec. 19, 1997

[51] Int. Cl.[6] ..... B24B 21/00; B24B 41/06

[52] U.S. Cl. ..... 451/305; 451/296; 451/299; 451/365

[58] Field of Search ..... 451/296, 299, 451/303, 305, 365

[56] References Cited

U.S. PATENT DOCUMENTS

| | | | |
|---|---|---|---|
| 1,954,708 | 4/1934 | Mass | 77/62 |
| 2,369,425 | 2/1945 | Becker | 90/59 |
| 2,676,413 | 4/1954 | Wharton et al. | 33/174 |
| 2,882,656 | 4/1959 | Novkov | 451/365 |
| 3,376,674 | 4/1968 | Ernesto | 451/365 |
| 3,967,816 | 7/1976 | Ramsperger et al. | 269/9 |
| 3,969,848 | 7/1976 | DeMusis | 451/303 |
| 4,257,195 | 3/1981 | Appelgren | 451/276 |
| 4,886,257 | 12/1989 | Witte | 269/9 |
| 5,107,599 | 4/1992 | Marincic et al. | 269/309 |

*Primary Examiner*—David A. Scherbel
*Assistant Examiner*—Philip J. Hoffmann
*Attorney, Agent, or Firm*—Sand & Sebolt

[57] ABSTRACT

An adjustment plate (10) is used for holding a fixture plate (12) adjustably on a grinder table (14). The adjustment plate (10) includes a shoulder bolt (30) that passes through the fixture plate (12) and threadably engages the adjustment plate (10). The adjustment plate (10) further includes a toggle bolt assembly (50) attached to the base of the adjustment plate to engage the fixture plate (12). The shoulder bolt (30) and the toggle bolt (50) allow the fixture plate (12) to be adjusted about the vertical axis of the adjustment plate (10). The adjustment plate (10) further includes a clamp (32) that is used to clamp the fixture plate (12) to the adjustment plate (10) when the fixture plate (12) is properly positioned. The adjustment plate (10) is attached to the grinder table (14) by a plurality of T-bolts (64) slidably received in T-bolt holes (70) in adjustment plate (10). A plurality of set screws (80) are threadably received in adjustment plate (10) and each engage the grinder table (14). The set screws (80) allow the adjustment plate (10) to be adjusted about the horizontal axes.

20 Claims, 6 Drawing Sheets

ADJUSTMENT PLATE

BACKGROUND OF THE INVENTION

1. Technical Field

The invention is generally related to an adjustment plate for a grinder. More particularly, the present invention relates to an intermediate adjustment plate for adjustably retaining a fixture plate on a grinder table. Specifically, the present invention relates to an adjustment plate that secures a fixture plate to a grinder table while being adjustable about three axes.

2. Background Information

Lost wax casting is a common method for fabricating small parts that require specific tolerances. Lost wax casting is used to form a wide variety of parts including aircraft parts, plumbing fixtures, engine parts, and the like. The process involves first forming a model of the desired part. The wax model is then coated with a suitable material such as silicon or ceramic that forms a rigid shell about the wax part. Then, as the name implies, the wax is melted out of the shell and a mold is formed. Molten metal may then be poured into the mold and allowed to cool to form the desired part.

The opening in the mold into which the molten metal is poured results in an unwanted protuberance of metal on the cooled part. This undesirable protuberance is referred to as a "gate" in the art and must be removed for the molded part to meet specifications. One typical method of removing a gate is to first cut a large portion of the gate off with a saw, removing another portion of the material with a grinder, and then machining the part to final specifications. In order to properly machine a part, the grinding operation must yield a surface that meets machining specifications. As such, the grinding step of the process must be precisely performed to yield a usable part.

The known grinding process uses a large grinder such as an AW Bell grinder that is capable of quickly grinding the unwanted material away by using relatively large forces and high speeds. The speed of the process, however, entirely relies on a proper set up for the part. Currently a set-up man must secure an individual part on a grinding table such that the unwanted material will contact the grinding surface at the proper angle when the grinding table was moved into an operating position. To obtain the proper alignment of a part, the set-up person utilizes a fixture plate that includes a clamp to hold the part against the plate. Due to the relatively large forces created by the grinding process, the fixture plate also includes a plurality of back stops or side stops that help counteract the force of the grinding process. The back stops and side stops are typically welded to the fixture plate and arranged specifically for a given part such that the part to be ground fits snugly within these stops. The part is then clamped to the plate by a suitable clamp that is attached to the plate.

The set-up man then carefully aligns the plate with the belt and clamps the plate to the grinder table. The process of properly aligning the plate includes using shims to tilt the fixture plate about its various axes. This process is time consuming and must be repeated for each fixture prior to grinding. It is not uncommon for the set up process to consume up to one hour per fixture. The time-intensive set-up process undesirably increases the cost of lost wax casted parts. It is thus desired in the art to provide an adjustment plate that holds the fixture plate to the grinder table and allows the set-up man to adjust the position of the fixture plate with respect to the grinder surface without employing the shims of the past.

SUMMARY OF THE INVENTION

In view of the foregoing, an objective of the present invention is to provide an adjustment plate that adjustably secures a fixture plate to a grinder table.

Another object of the present invention is to provide an adjustment plate that is capable of securely retaining known fixture plates.

Still another objective of the present invention is to provide an adjustment plate that provides for adjustment about three axes when attached to the grinder table.

Yet another objective of the present invention is to provide an adjustment plate that allows the orientation of the part to be ground to be adjusted without unclamping the part from the fixture plate or unclamping the fixture plate from the adjustment plate.

A further objective of the present invention is to provide an adjustment plate that substantially reduces the set-up time for aligning a part to be ground.

Still a further objective of the present invention is to provide an adjustment plate which is of simple construction, which achieves the stated objectives in a simple, effective, and inexpensive manner, and which solves the problems and which satisfies the needs existing in the art.

These and other objectives and advantages are obtained by the adjustment plate of the present invention, the general nature of which may be stated as including a base having two perpendicular horizontal axes and a normal vertical axis; means for connecting a fixture plate to the base; second means attached to the base for adjusting the fixture plate about the vertical axis; third means for attaching the base to the grinder table; and fourth means attached to the base for adjusting the base about both horizontal axes.

BRIEF DESCRIPTION OF THE DRAWINGS

A preferred embodiment of the invention, illustrative of the best mode in which the applicant contemplated applying the principles of the invention, is set forth in the following description and is shown in the drawings and is particularly and distinctly pointed out and set forth in the appended claims.

DESCRIPTION OF THE PREFERRED EMBODIMENT

The adjustment plate of the present invention is indicated generally by the numeral 10 in the accompanying drawings.

Figure 1:
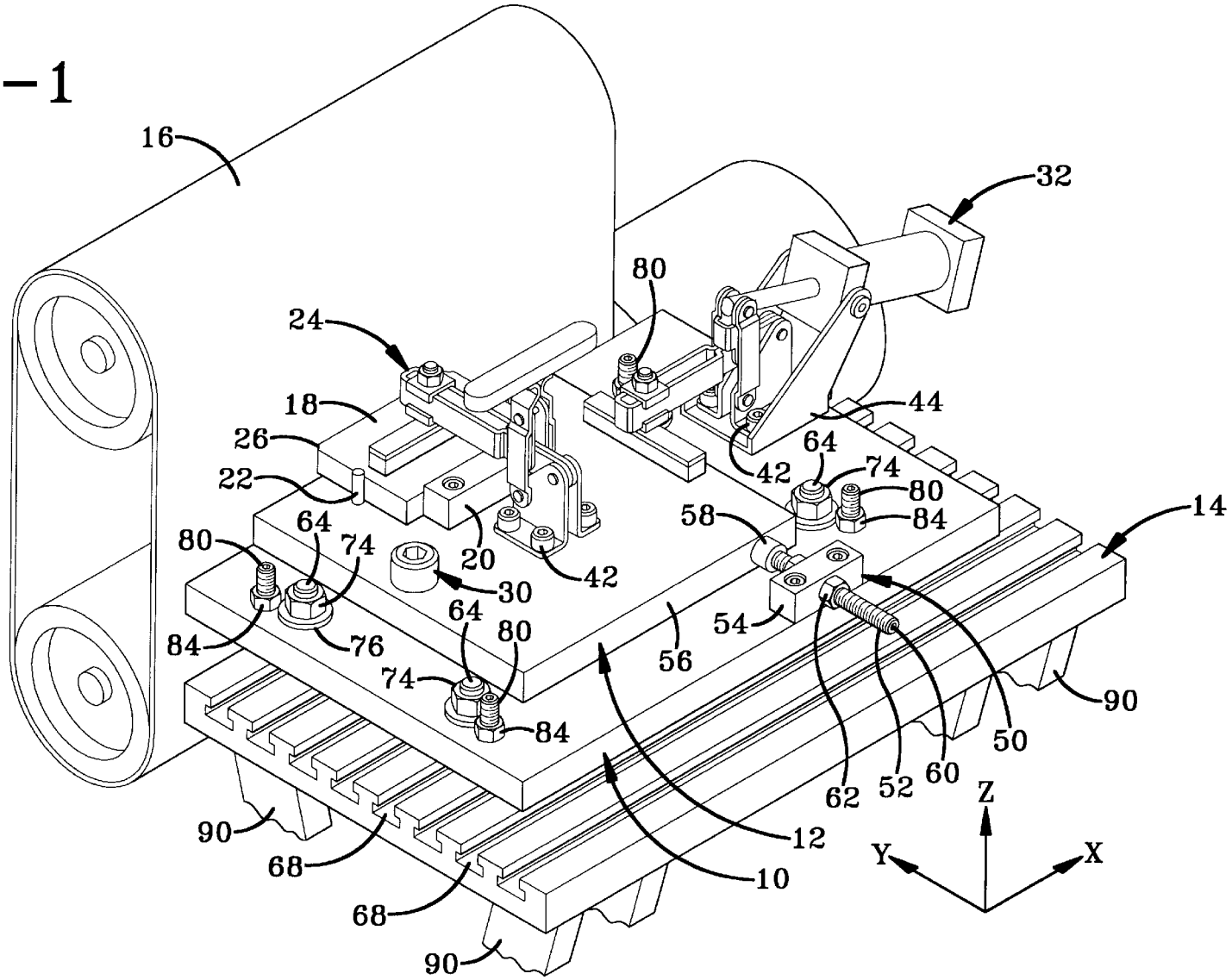
FIG. 1 is a perspective view of the adjustment plate of the present invention holding a fixture plate on a grinder table.
Figure 2:
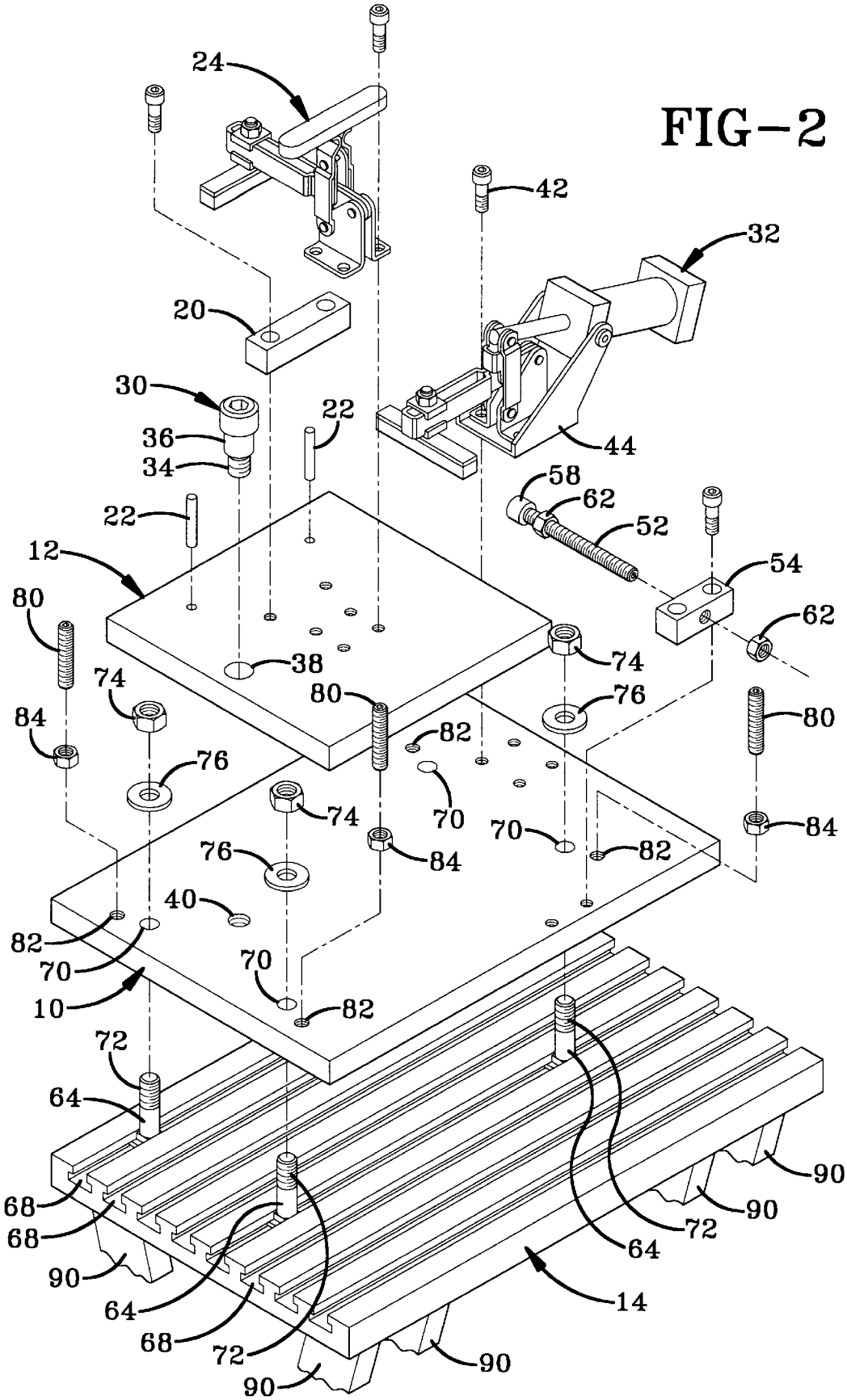
FIG. 2 is an exploded view depicting the relationship between the adjustment plate the fixture plate, and the grinder table.

Adjustment plate 10 holds a fixture plate, indicated generally by the numeral 12, to a grinder table, indicated generally by the numeral 14. When in use, adjustment plate 10 allows a set-up man to adjust the position of fixture plate 12 about three axes, namely the X, Y, and Z axes depicted in FIG. 1. These adjustments are with respect to grinder table 14 and a grinding surface 16 which may be in the form of the belt as depicted in the drawings. It is to be understood that adjustment plate 10 may be used with tools other than the grinder depicted in the drawings and specifically described herein.

Figure 8:
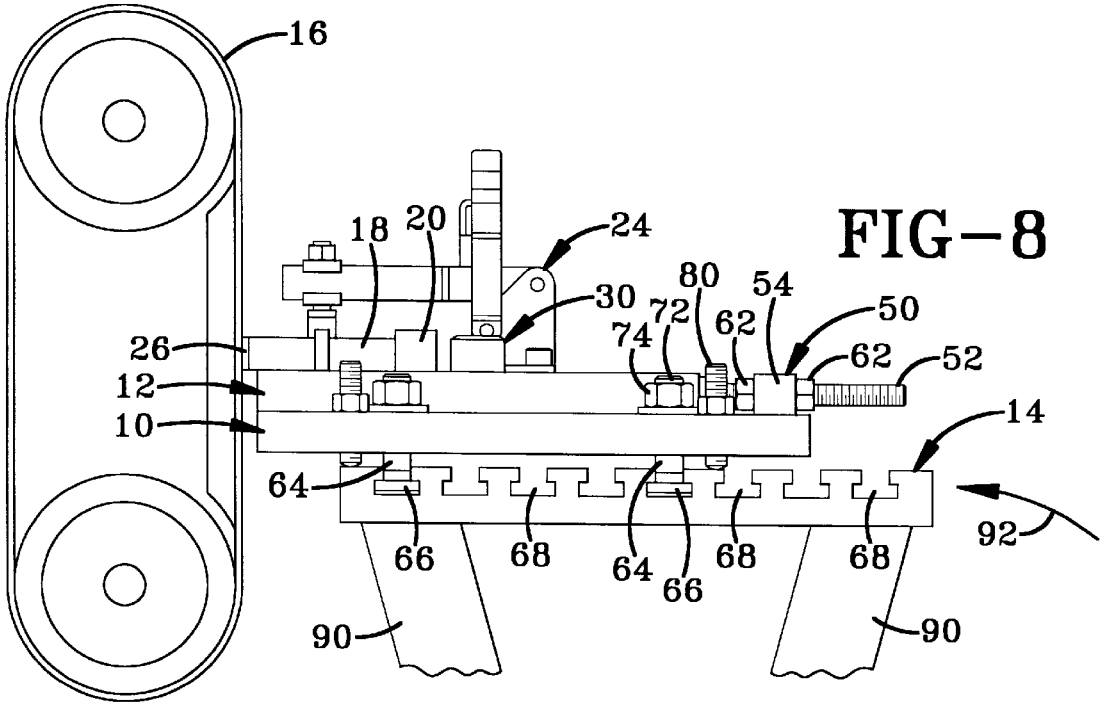
FIG. 8 is a schematic, side elevational view of the adjustment plate holding a fixture plate to a grinder table, the grinder table in the grinding position.

As described in the Background of the Invention section of this specification, fixture plate 12 holds a part 18 to be ground in a secure fashion such that it may be accurately and safely ground. Fixture plate 12 thus includes a plurality of stops such as a back stop 20 and a pair of side stops 22. Stops 20, 22 are positioned specifically for a given part 18 such that part 18 fits snugly within stops 20, 22. Stops 20, 22 are typically welded to fixture plate 12 but may also be bolted in certain situations. Stops 22 may also be fitted dowel pins as depicted in the drawings. Part 18 is further held to fixture plate 12 by a clamp 24. Although numerous clamps 24 may be utilized to perform this clamping function, a DESTACO toggle clamp is utilized in the preferred embodiment of the present invention. Fixture plate 12 and stops 20, 22 are configured such that the gate 26 of part 18 overhangs fixture plate 12. The overhang is required so that grinding surface 16 does not contact fixture plate 12 or adjustment plate 10 when grinder table 14 is in the grinding position as shown in FIG. 8. It is to be noted that adjustment plate 10 is also configured to overhang table 14. Although other materials may be suitable, it is known in the art to fabricate fixture plate 12 from steel having a thickness sufficient to withstand the significant forces created during the grinding operation.

Figure 4:
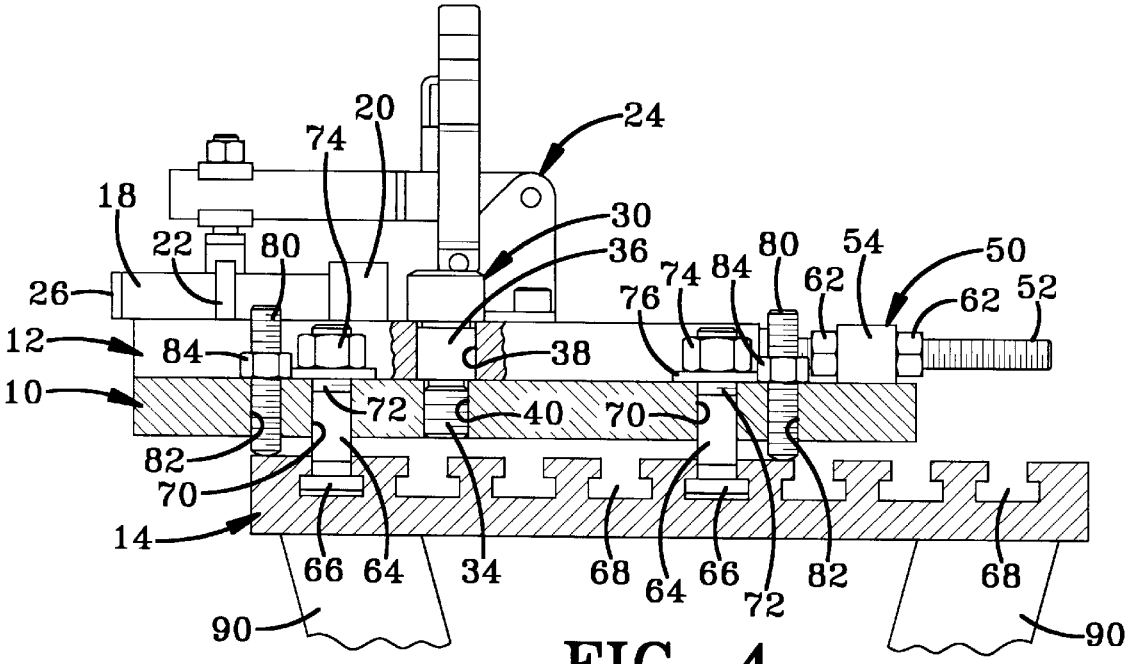
FIG. 4 is a sectional view taken along line 4—4 of FIG. 3.

Fixture plate 12 is attached to adjustment plate 10 by a shoulder bolt, indicated generally by the numeral 30, and a clamp, indicated generally by the numeral 32. Shoulder bolt 30 includes a threaded portion 34 and a shouldered portion 36. Shoulder bolt 30 is received in a shoulder bolt hole 38 in fixture plate 12. Hole 38 of fixture plate 12 is not threaded as may be seen most clearly in FIG. 4. Hole 38 of fixture plate 12 is positioned to align with shoulder bolt hole 40 of adjustment plate 10 when fixture plate 12 is properly aligned with adjustment plate 10. Hole 40 in adjustment plate 10 is threaded as to threadably engage threaded portion 34 of shoulder bolt 30. Thus, it may be understood that fixture plate 12 may rotate with respect to adjustment plate 10 about the normal, vertical or Z axis, when shoulder bolt 30 is loosely disposed in shoulder bolt holes 38 and 40.

Clamp 32 is attached to adjustment plate 10 by suitable means such as bolts 42. It may be understood that clamp 32 may also be welded or otherwise attached to adjustment plate 10. Clamp 32 is positioned such that its base 44 does not interfere with fixture plate 12. In one embodiment of the present invention, clamp 32 is an air clamp that includes an air piston 46. One air clamp that is particularly useful for this application is a DeStaco air clamp. In other embodiments of the present invention, other clamping devices may be used in this application. Clamp 32 is used to provide a downward force on fixture plate 12 to hold fixture plate 12 against adjustment plate 10. It may thus be understood that fixture plate 12 may not be moved with respect to adjustment plate 10 once clamp 32 is in its clamped position.

Figure 3:
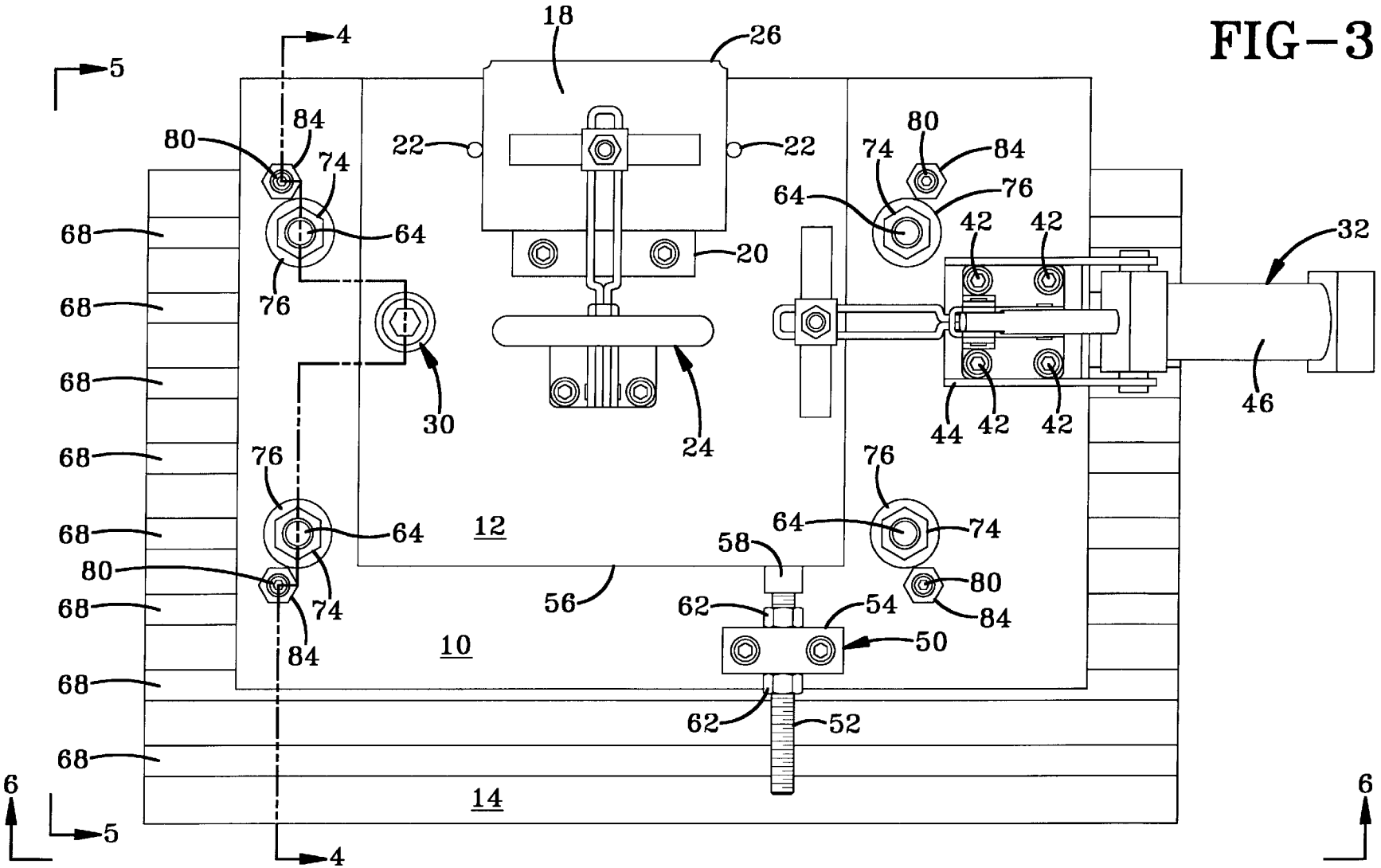
FIG. 3 is a top-plan view of FIG. 1.

Adjustment plate 10 also includes a device that allows the set up man to pivot fixture plate 12 about the vertical, or Z, axis when shoulder bolt 30 and clamp 32 are loose. It is understood that numerous devices are known to those skilled in the art that will properly perform this function. Thus, in one embodiment of the present invention, a toggle bolt assembly 50 is used to provide for this adjustment. Toggle bolt assembly 50 includes a threaded rod 52 that threadably engages a block 54 that is securely attached to adjustment plate 10 by appropriate means such as bolting or welding. Toggle bolt assembly 50 is positioned such that threaded rod 52 engages the rear surface 56 of fixture plate 12. A toggle shoe 58 may be provided on the engagement end of threaded rod 52 to provide a non-damaging, substantially frictionless engagement between shoe 58 and rear surface 56. A socket-shaped cavity 60 may also be provided to allow for easy turning of threaded rod 52. Locking nuts 62 are provided on either side of block 54 to lock the position of threaded rod 52 with respect to block 54 and fixture plate 12. It may thus be understood that fixture plate 12 may be pivoted about shoulder bolt 30 in the counterclockwise direction of FIG. 3 when threaded rod 52 is rotated clockwise if bolt 30 and clamp 32 are loose. As such, toggle bolt assembly 50 allows fixture plate 12 to be adjusted with respect to adjustment plate 10 about the vertical Z axis. It may be understood that the adjustment of plate 12 is not limited to specific increments because the threads on bolt 52 and in block 54 are continuous. Furthermore, the sensitivity of the adjustment may be varied by changing the pitch of the threads on both parts 52 and 54. Thus, plate 12 may be continuously adjusted to an infinite number of positions.

Adjustment plate 10 must also be able to be secured to grinder table 14. As such, an appropriate attachment and securement device is provided. In one embodiment of the present invention, adjustment plate 10 is secured to grinder table 14 by a plurality of T-bolts 64. Other types of bolts 64 may also be used. Each T-bolt 64 includes a head 66 that slidably engages one of a plurality of substantially parallel T-slots 68 of grinder table 14. T-bolts 64 are received in T-bolt holes 70 in adjustment plate 10. Holes 70 are not threaded such that each T-bolt 64 slidably engages adjustment plate 10. Each T-bolt 64 includes a threaded portion 72 that threadably engages a nut 74. It may be preferred to also employ a washer 76 between the nut 74 and adjustment plate 10. It may thus be understood that T-bolt 64 and nut 74 may be used to securely retain adjustment plate 10 to grinder table 14 when each bolt 64 engages T-slot 68.

Figure 5:
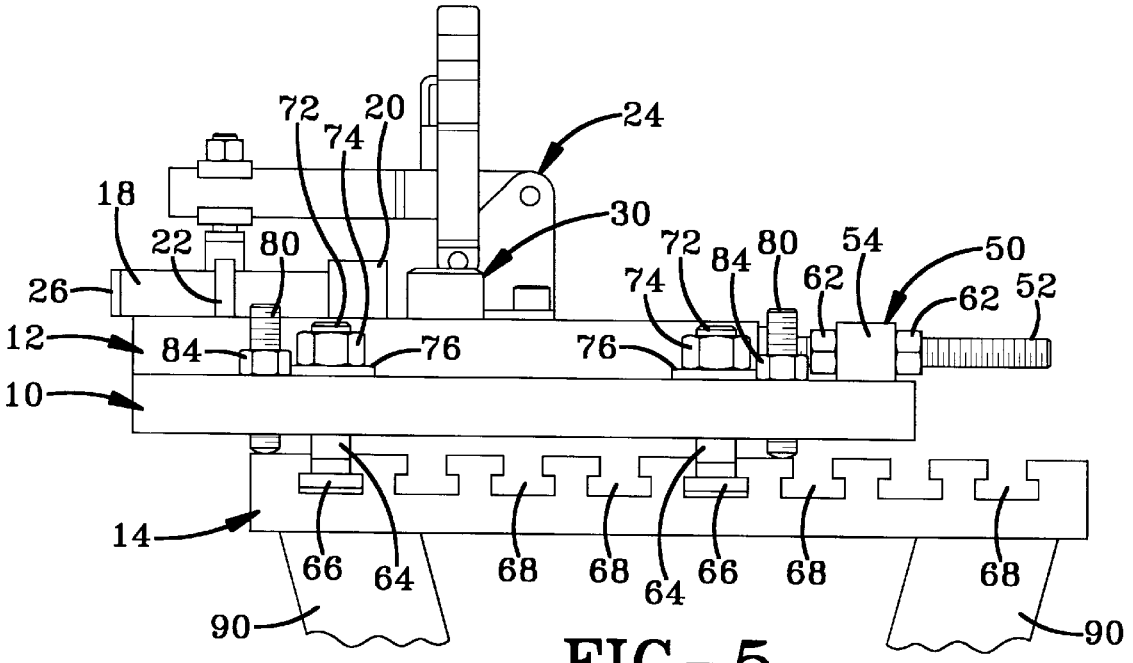
FIG. 5 is a side elevational view taken along line 5—5 of FIG. 3.
Figure 6:
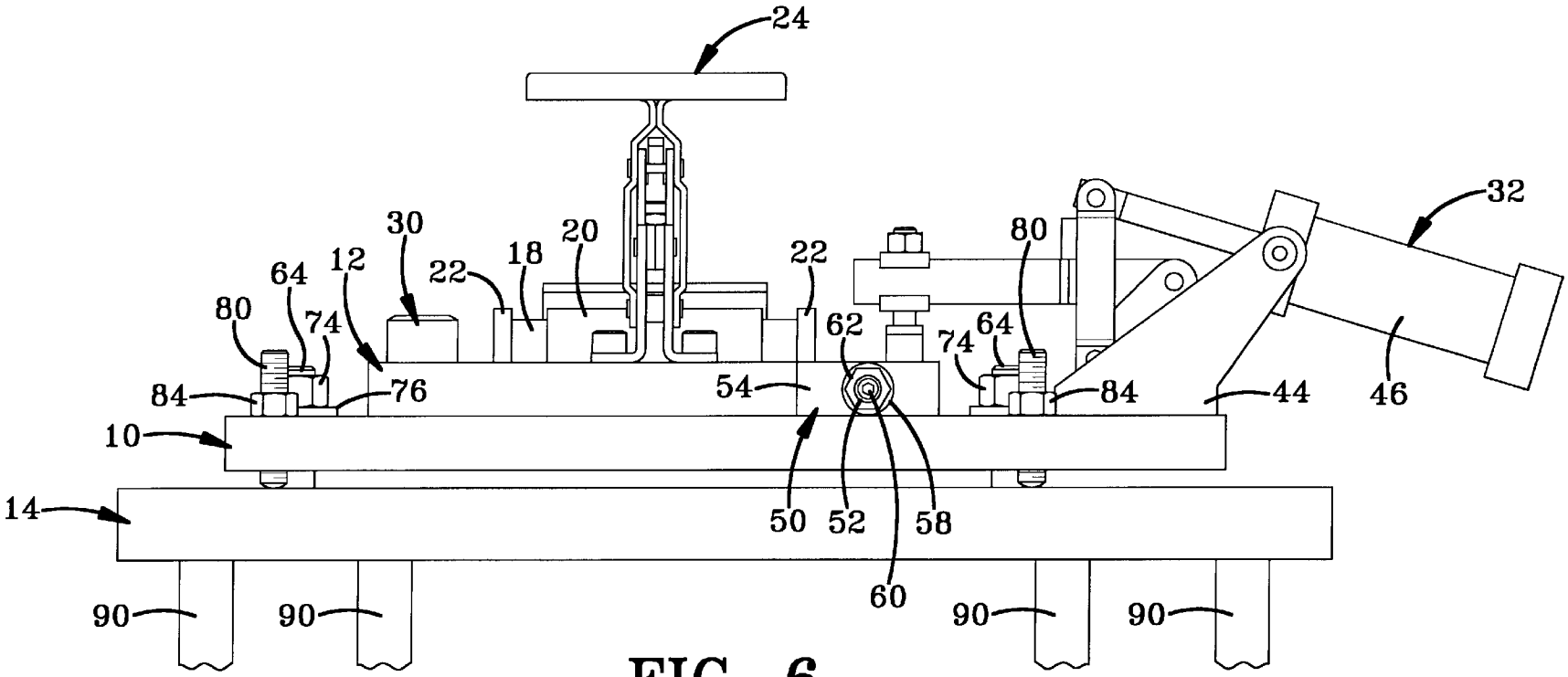
FIG. 6 is a rear elevational view taken along line 6—6 of FIG. 3.

Adjustment plate 10 may also be adjusted with respect to table 14 about the X and Y horizontal axes. Such adjustment allows the orientation of part 18 to be adjusted about the X and Y axes as part 18 is securely held to fixture plate 12 which is, in turn, securely held to adjustment plate 10. To provide for such adjustment, a plurality of set screws 80 threadably engage corresponding set screw holes 82 in adjustment plate 10. Set screw holes 82 are disposed to cause each set screw 80 to engage grinder table 14 between T-slot 68 openings as may be seen in FIG. 4. Each set screw 80 has an inset key cavity such that each may be turned with an appropriate set screw key even when turned below the upper surface of adjustment plate 10. It is desirable, however, to provide screws 80 that are long enough to substantially protrude through the top of plate 10 such that a lock nut 84 may be employed. Set screws 80 are used to adjust the position of adjustment plate 10 about the X and Y horizontal axes of grinder table 14. As may be seen in FIG. 5, the left side of adjustment plate 10 may be lifted off of grinder table 14 such that adjustment plate 10 is rotated about the Y axis. FIG. 6 depicts the use of set screws 80 to lift the rear end of adjustment plate 10 off of grinder table 14. As explained above with respect to toggle bolt assembly 50, the adjustment provided by screws 80 is continuous because the threads are continuous. This adjustment arrangement allows the position of part 18 to be precisely established.

It may now be understood that adjustment plate 10 provides means for securely holding fixture plate 12 on grinder table 14 while allowing the position of fixture plate 12 to be adjusted about the X, Y, and Z axes. With the foregoing structure described, the use of adjustment plate 10 will now be described. First, adjustment plate 10 is loosely attached to grinder table 14 by inserting T-bolts 64 into the appropriate T-slots 68. Adjustment plate 10 is then placed over T-bolts 64 and washers 76 and nuts 74 are added. Next, fixture plate 12 is placed on adjustment plate 10 and shoulder bolt 30 is threaded into adjustment plate 10 but not securely tightened. Shoulder bolt 30 is left loose enough to allow adjustment plate 12 to be pivoted about shoulder bolt 30 with respect to adjustment plate 10. Part 18 is then placed between stops 20, 22 and clamped to fixture plate 12 by clamp 24. Part 18 is checked to be sure that gate 26 overhangs fixture plate 12 and adjustment plate 10 by an amount sufficient to prevent grinding surface 16 from engaging fixture plate 12 or adjustment plate 10. Next, toggle bolt assembly 50 is used to square part 18 to grinding surface 16. Once part 18 is properly aligned, shoulder bolt 30 is tightened and the alignment of part 18 is checked again. If the alignment is correct, clamp 32 is activated to securely retain fixture plate 12 with respect to adjustment plate 10. Lastly, adjustment plate 10 is adjusted with respect to the X and Y axes by turning set screws 80 to provide the proper orientation of part 18 with respect to grinding surface 16. Once this desired orientation is obtained, nuts 74 are completely tightened to provide a secure connection between adjustment plate 10 and grinder table 14.

Figure 7:
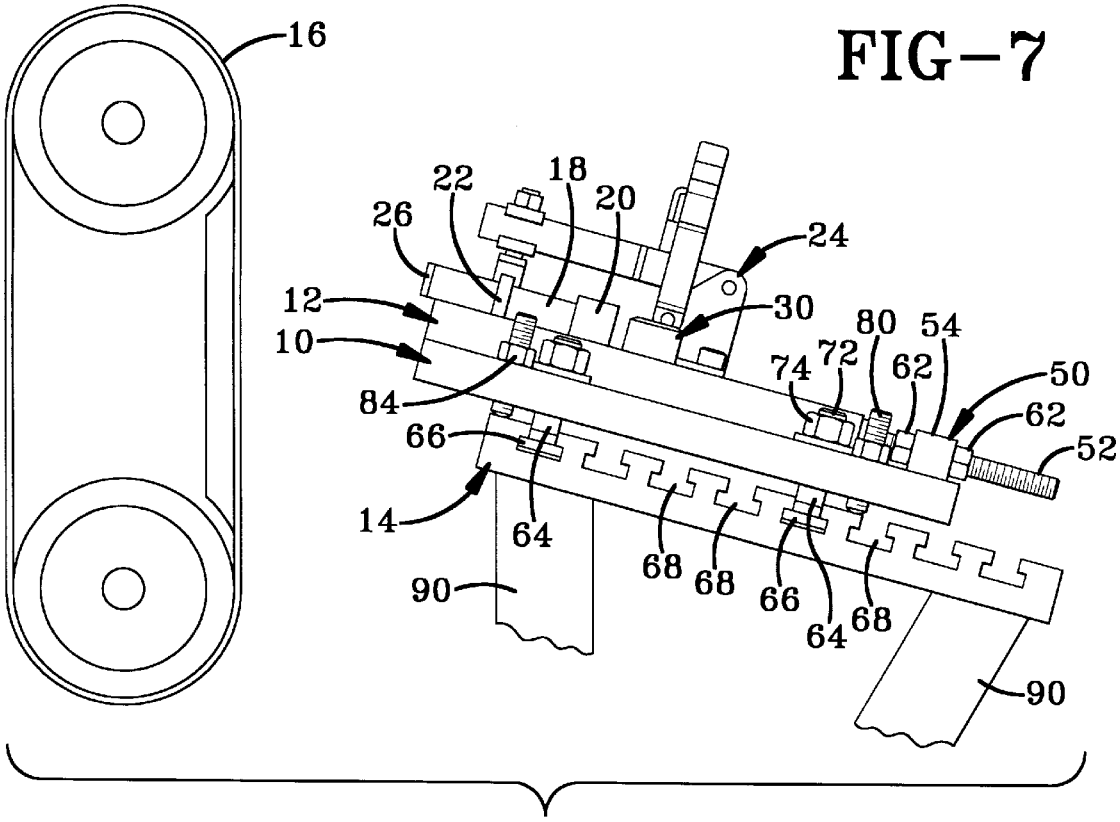
FIG. 7 is a schematic, side elevational view of the adjustment plate holding a fixture plate to a grinder table, the grinder table in a set up position.

The above-described steps are performed when grinder table 14 is in the set-up position depicted in FIG. 7. Grinder table 14 is supported by a plurality of support members 90 that allow grinder table 14 to be pivoted between the set up position depicted in FIG. 7 and the grinding position depicted in FIG. 8. During set up, the set-up man may make the desired adjustments and pivot grinder table 14 up towards grinding surface 16 while grinding surface 16 is idle. Once adjustment plate 10 is secured to grinder table 14 and part 18 is properly aligned, grinding surface 16 is activated and grindertable 14 is pivoted upwardly in direction of arrow 92 such that gate 26 contacts grinding surface 16 where the grinding occurs. When the grinding process is complete, grinder table 14 is pivoted back to the set-up position and part 18 is removed. The next part 18 may then be inserted and ground.

Accordingly, the improved adjustment plate apparatus is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness, and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries, and principles of the invention, the manner in which the adjustment plate is constructed and used, the characteristics of the construction, and the advantageous new and useful results obtained; the new and useful structures, devices, elements, arrangements, parts, and combinations are set forth in the appended claims.

I claim:

1. An adjustment plate for adjustably holding a fixture plate on a grinder, said adjustment plate comprising:

a base having three axes, each of said axes being substantially perpendicular to each of the other axes;

first means for connecting the fixture plate to said base;

second means attached to said base for pivotally adjusting the fixture plate with respect to said base about one of said axes;

third means for attaching said base to the grinder; and fourth means attached to said base for pivotally adjusting said base about at least another of said axes with respect to the grinder.

2. An adjustment plate according to claim 1 wherein said first means includes a shoulder bolt, the fixture plate having a shoulder bolt hole, said base having a threaded shoulder bolt hole, said shoulder bolt being slidably received in the shoulder bolt hole of the fixture plate and threadably received in the shoulder bolt hole of said base.

3. An adjustment plate according to claim 2 wherein said first means further includes a clamp attached to said base.

4. An adjustment plate according to claim 1 wherein said second means includes a toggle bolt attached to said base.

5. An adjustment plate according to claim 4 wherein said toggle bolt includes a block attached to said base, a threaded rod threadably engaging said block, and a pair of lock nuts threadably engaging said threaded rod, said lock nuts disposed on opposite sides of said block; said threaded rod disposed to engage the fixture plate.

6. An adjustment plate according to claim 1 wherein said third means includes a plurality of T-bolts, each of said T-bolts engaging the grinder and extending through said base and a nut threadably engaging each of said T-bolts.

7. An adjustment plate according to claim 1 wherein said second means provides for continuous adjustment.

8. An adjustment plate according to claim 1 wherein said fourth means provides for continuous adjustment.

9. An adjustment plate according to claim 1, wherein set fourth means also may be used to pivotally adjust said base about the third axis.

10. An adjustment plate for adiustably holding a fixture plate on a grinder, said adjustment plate comprising;

a base having three axes, each of said axes being substantially perpendicular to each of the other axes;

first means for connecting the fixture plate to said base;

second means attached to said base for adjusting the fixture plate with respect to said base about one of said axes;

third means for attaching said base to the grinder;

fourth means attached to said base for adjusting said base about at least another of said axes with respect to the grinder; and said fourth means including a plurality of set screws threadably engaging said base, each of said set screws being received in a set screw hole that passes entirely through said base, each of said set screw holes disposed such that each of said set screws may engage the grinder.

11. An adjustment plate according to claim 10 wherein said fourth means further includes a lock nut threadably engaged with each of said set screws.

12. An adjustment plate for holding a fixture plate to a grinder table, said adjustment plate comprising:

a base having a pair of substantially perpendicular horizontal axes and a substantially vertical normal axis, said base defining a fixture plate-receiving area;

a shoulder bolt having a shoulder and a threaded portion, said threaded portion being at least partially threadably disposed in a threaded shoulder bolt hole in said base;

a clamp attached to said base outside said fixture plate-receiving area;

a toggle bolt assembly attached to said base;

a plurality of T-bolts, each of said T-bolts at least partially slidably received in a T-bolt hole in said base; and a plurality of set screws, each of said set screws threadably received in a threaded set screw hole in said base.

13. An adjustment plate according to claim 12 wherein each of said set screws is disposed to engage the grinder table allowing said base to be adjusted about said horizontal axes.

14. An adjustment plate according to claim 12 wherein said toggle bolt is disposed to engage the fixture plate to allow the fixture plate to be adjusted with respect to said base about said vertical axis.

15. An adjustment plate according to claim 12 wherein said clamp is disposed to engage the fixture plate when the fixture plate is held on the adjustment plate.

16. In combination, a grinder having a grinder table, an adjustment plate, end a fixture plate that holds a part to be ground;

a bolt connecting said fixture plate to said adjustment plate; said fixture plate selectively pivoting about said bolt with respect to said adjustment plate about a first axis;

at least three screws threadably engaging said adjustment plate and engaging said grinder table, at least one of the screws holding a portion of the adjustment plate spaced from the grinder table, rotation of at least one scraw causing the adjustment plate to be adjusted with respect to the grinder table whereby the orientation of the fixture plate and adjustment plate may be selectively adjusted with respect to the grinder table by the user by selectively rotating at least one of the screws; and a connector connecting said adjustment plate to said grinder table.

17. The combination of claim 16, wherein said connector includes at least three T-bolts.

18. The combination of claim 16, further comprising a toggle bolt attached to said adjustment plate, said toggle bolt engaging said fixture plate.

19. The combination of claim 16, further comprising a clamp mounted on the adjustment plate, said clamp selectively engaging said fixture plate.

20. The combination of claim 16, wherein said first bolt is a shoulder bolt, the fixture plate having a shoulder hole, said adjustment plate having a threaded shoulder bolt hole, said shoulder bolt being slideably received in the shoulder bolt hole of the fixture plate and threadably received in the shoulder bolt hole of said adjustment plate.

* * * * *